US005492738A

United States Patent [19]

Aoyama

[11] Patent Number: 5,492,738

[45] Date of Patent: Feb. 20, 1996

[54] ARTIFICIAL-FLOWER-FORMING RIBBON

[75] Inventor: Ryuji Aoyama, Nagoya, Japan

[73] Assignee: Kabushiki Kaisha Aoyama, Nagoya, Japan

[21] Appl. No.: 304,355

[22] Filed: Sep. 12, 1994

[30] Foreign Application Priority Data

Jun. 13, 1994 [JP] Japan ..... 6-153036

[51] Int. Cl.[6] ..... A41G 1/00; D04D 7/10

[52] U.S. Cl. ..... 428/4; 156/70; 223/46; 428/24; 428/101

[58] Field of Search ..... 428/4, 24, 101; 156/70; 223/46

[56] References Cited

U.S. PATENT DOCUMENTS 3,637,455 1/1972 Pearson et al. ..... 428/4
4,476,168 10/1984 Aoyama ..... 420/4
4,713,267 12/1987 Truskolaski ..... 428/4
4,822,648 4/1989 Cheng ..... 428/4
5,026,578 6/1991 Iname ..... 428/4

*Primary Examiner*—Henry F. Epstein
*Attorney, Agent, or Firm*—Graybeal Jackson Haley & Johnson

[57] ABSTRACT

A ribbon comprises a pair of facing strips and at least one string disposed between both the strips. Both the strips and the string are joined together at their one ends, and both the strips are joined to each other at a plurality of points on each of a plurality of lines spaced apart from each other in the longitudinal direction so that both the strips can be moved relative to the string in their longitudinal direction. Each strip has at least one slit extending in the longitudinal direction either between a joint in one end of the strip and a line adjacent thereto or between two lines adjacent to each other. A plurality of pairs of facing strips similarly joined by a plurality of lines spaced apart from each other in their longitudinal direction are also disclosed.

2 Claims, 6 Drawing Sheets

ARTIFICIAL-FLOWER-FORMING RIBBON

BACKGROUND OF THE INVENTION

1. Field of the Invention

This invention relates to a ribbon for forming an artificial flower to be used for ornamentation of an article, decoration of a room, and so forth.

2. Description of the Prior Art

As an example of such a ribbon, U.S. Pat. No. 4,476,168 discloses an artificial-flower-forming ribbon comprising: a pair of confronting strips and at least one string disposed therebetween, wherein both the strips and the string are joined together at one of the ends thereof, and wherein both the strips are joined together at a plurality of points on each of a plurality of transverse lines spaced apart from each other in the longitudinal direction so that both the strips can be moved relative to the string in the longitudinal direction of the string.

According to this conventional artificial-flower-forming ribbon, when both the strips are moved relative to the string in the longitudinal direction of the string, both ends of both the strips approach each other, and the portion between the one ends of the strips and the line adjacent thereto as well as portions between lines adjacent to each other are transformed into loop-like shapes, and an artificial flower is formed, making these loop-like transformed portions its petals.

In the foregoing conventional ribbon, distances between respective lines are made different to vary the sizes of the loop-like petals to better the decorative property of the artificial flower, whereas it is considered that the decorative property of the artificial flower is improved by varying the shapes of the petals, in place of or in addition to varying the sizes of the petals.

An object of the present invention is to improve the decorative property of the artificial flower formed from the ribbon.

The present invention relates to an artificial-flower-forming ribbon comprising a pair of confronting strips and at least one string disposed therebetween, wherein both the strips and the string are joined together at one of the ends thereof, and wherein both the strips are joined together at a plurality of points on each of a plurality of transverse lines spaced apart from each other in the longitudinal direction of both the strips so that the strips can be moved relative to the string in the longitudinal direction of the string, and wherein each strip has at least one slit extending in their longitudinal direction either between the joint at its one end and the line adjacent to the joint or between two lines adjacent to each other.

Another form of artificial-flower-forming ribbon according to the present invention comprises a plurality of juxtaposed pairs of strips and at least one string disposed between one of the pairs of strips, wherein the one pair of strips and the string are joined together at their one ends, and wherein the pairs of strips are joined together at a plurality of points on each of a plurality of transverse lines spaced apart from each other in their longitudinal direction so that the plurality of pairs of strips can move relative to the string in the longitudinal direction of the string.

The distances between the lines are preferably increased gradually from one ends of the strips toward the other ends thereof.

SUMMARY OF THE INVENTION

According to the present invention, when both the strips are moved relative to the string in its longitudinal direction to transform the strip portions between the one ends of both the strips and the line adjacent to the one ends as well as the strip portions between the lines adjacent to each other respectively into loop-like shapes, a part or the whole of the strip portions are transformed into a plurality of narrow loop-like petals. Thereby, an artificial flower with petals different in shape from the conventional one can be obtained. The plurality of petals with narrow widths present fineness, gorgeousness, and so forth, and improve the decorative property of the artificial flower.

Further, according to another form of the present invention, when a plurality of pairs of the confronting strips are moved relative to the string in the longitudinal direction, the strip portions between the one ends of the pairs of strips and the line adjacent to the one ends as well as the strip portions between lines adjacent to each other are respectively transformed into a plurality of loop-like petals. Thereby, an artificial flower having petals different in shape from the conventional one can be obtained. Each of the set of petals presents fineness, gorgeousness and so forth to improve the decorative property of the artificial flower.

In either of these examples, by setting the distances between the lines so as to gradually increase from the one ends of the strips toward the other ends, an artificial flower having a plurality of loop-like petals formed from one strip portion and varying little by little in size can be obtained.

DETAILED DESCRIPTION OF PREFERRED EMBODIMENTS

Figure 1:
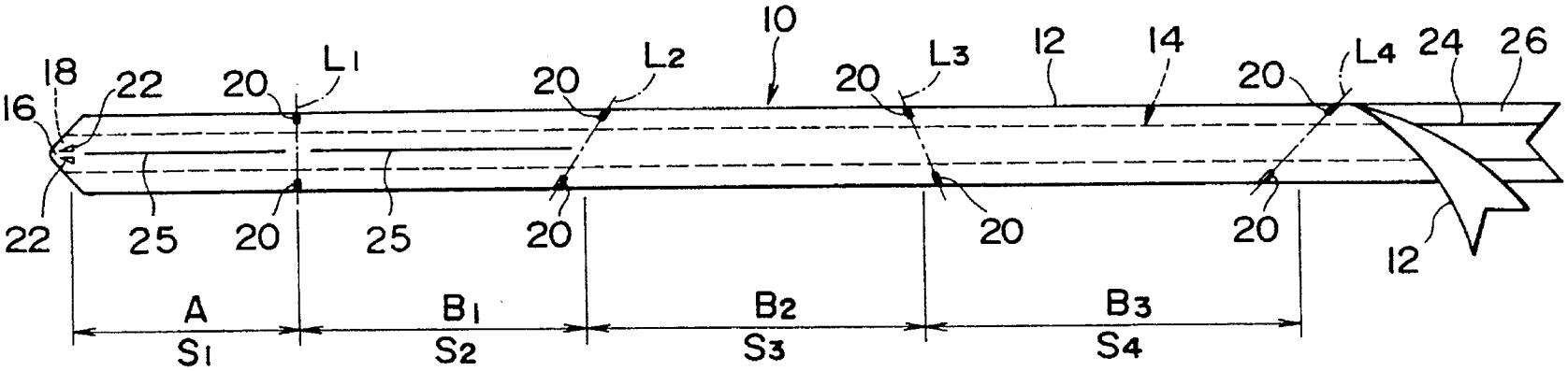
FIG. 1 is a plan view of the artificial-flower-forming ribbon according to the present invention.

Referring to FIG. 1, the artificial-flower-forming ribbon according to the present invention is indicated as a whole by the reference numeral 10.

The ribbon 10 has a pair of confronting strips 12 and at least one (two in the illustrated embodiment) string 14 disposed between both the strips 12 and extending along both the strips nearly in their middle portion. Both the strips 12 and the string 14 are joined together at one ends 16, 18 thereof. Both the strips 12 are joined together at a plurality of portions or points 20 (two points in the illustrated embodiment) on each of a plurality of lines $L_1$–$L_4$ spaced apart from each other in the longitudinal direction of the strips 12 and crossing the strips, in more detail, at both sides of the string 14 so that both the strips 12 can be moved relative to the string 14 in the longitudinal direction of the string.

The strips 12 and the string 14 are respectively made of woven fabric of synthetic fiber such as nylon fiber or polyester fiber as in the illustrated embodiment as well as of non-woven fabric, plastic tape such as polypropylene tape or vinyl tape, paper tape, woven fabric of natural fiber, non-woven fabric of natural fiber, or the like. In the illustrated embodiment, the strips 12 are joined together at the points indicated by the numeral 20 and the strips 12 and the string 14 are joined together at two points indicated by the numeral 22, by welding or heat-sealing,. They can be joined not by welding or heat-sealing such as above but by using such joining means as, for example, sewing, adhesion, eyelet, stapler, or the like.

The line L, crosses both the strips 12 straight, while the lines $L_2$, $L_3$ and $L_4$ respectively cross them diagonally, and the directions of the inclination alternate. The angles at which the lines cross both the strips can be arbitrarily determined. Depending on the angles set for the lines to cross both the strips, the angle between a pair of petals of the below-mentioned artificial flower and the relative position of each pair of petals around the string 14 are varied. Further, the number of the lines can be arbitrarily determined, and with the number of the lines, the number of the petals varies.

Figure 2:
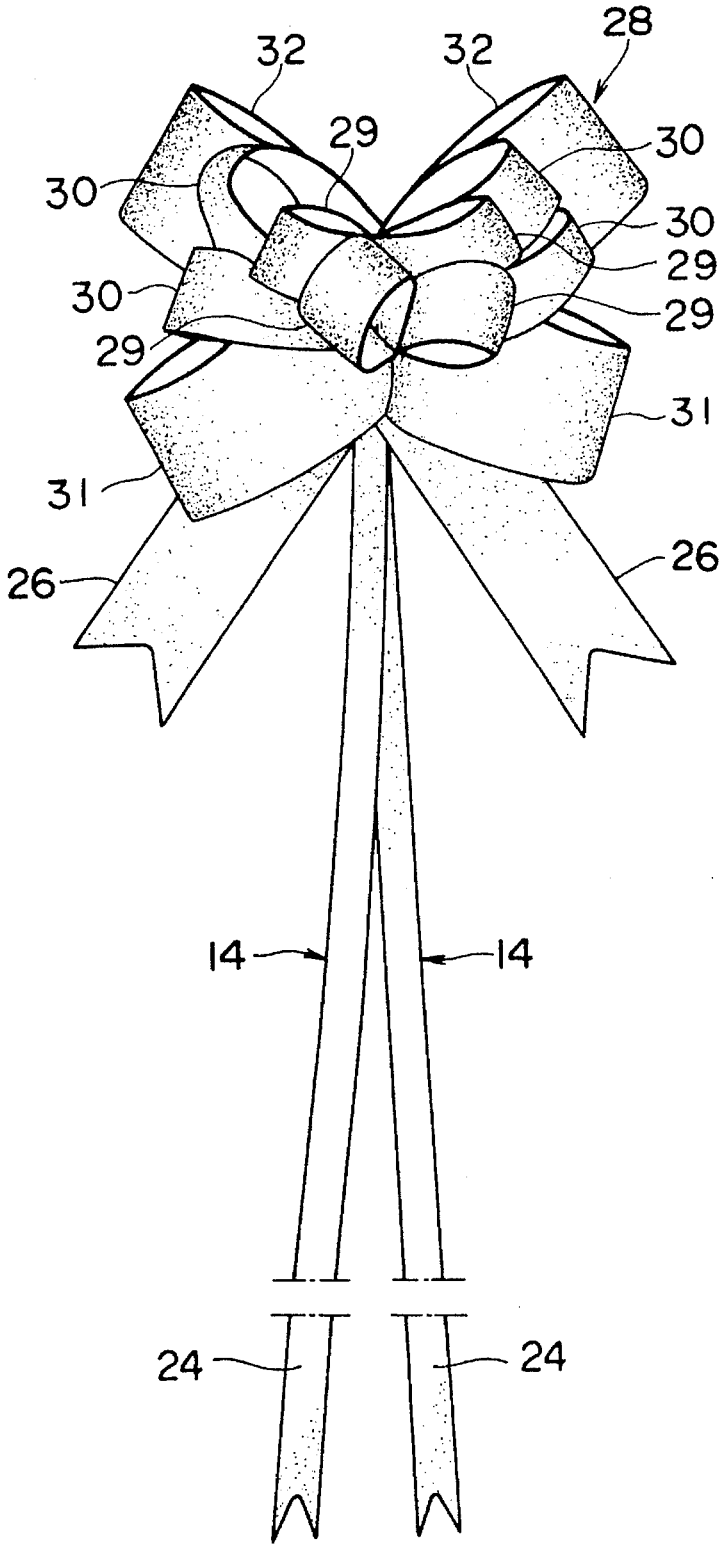
FIG. 2 is a perspective view of the artificial flower formed from the ribbon shown in FIG. 1.

By moving both the strips 12 relative to the string 14 leftward as viewed in FIG. 1, an artificial flower 28 (FIG. 2) can be formed from the ribbon 10. By the relative movement of both the strips 12, both ends 16, 26 of both the strips 12 approach each other, so that portions A where both the strips face each other between the joint 22 at one ends 16 of both the strips 12 and the line $L_1$ adjacent to the joint 22 as well as portions $B_1$–$B_3$ between respective pairs of lines adjacent to each other in the longitudinal direction, that is, between $L_1$ and $L_2$, between $L_2$ and $L_3$, and between $L_3$ and $L_4$ are transformed into loop-like shapes. Portions 29–32 transformed into loop-like shapes form petals of an artificial flower 28.

Though the distance S, between the joint 22 at one ends 16 of both the strips and the line $L_1$ adjacent thereto as well as the distances $S_2$, $S_3$ and $S_4$ between respective pairs of lines can be arbitrarily determined, they are preferably set to gradually increase from the one ends 16 of both the strips toward the other ends 26, as shown in the illustrated embodiment. In this manner, the sizes of the petals of the artificial flower 28 gradually decrease from the other ends 24 (free ends) of the string 14 toward the one ends 18 thereof, and tile petals 29 nearest to the flower center become the smallest ones.

Each strip 12 is provided with a slit 25 extending in the longitudinal direction of the strip 12 along its portions A and B,. In the illustrated embodiment, both slits 25 in the portions A and B, of each confronting pair of strips face each other and have the same length. However, it is possible to set both the slits 25 in each portion not to face each other, instead of the foregoing, or to have different lengths. In addition to the illustrated embodiment, the slits 25 can be provided in one or more other portions $B_2$, $B_3$ of each strip 12. Also, the slits 25 may be provided at one portion A of each strip 12 or at least one of the portions $B_1$–$B_3$.

In forming an artificial flower, the portions A and B, of the strips provided with the slits 25 are transformed into loop-like shapes such that each portion separated by each slit 25 forms an independent loop, and together with the petals 31, 32 formed by a transformation of the portions $B_2$, $B_3$ without the slit 25 into loop-like shapes, respectively compose petals 29, 30 with narrow widths. These petals 29, 30 having a width half as much as that of the petals 31, 32 and express fineness, brilliance and gorgeousness owing to the narrow width, and contribute to improving the decorative property of the artificial flower. Further, in the illustrated embodiment, due to the contrast between the petals having different shapes, that is, between the petals 31, 32 with a broader width and the petals 29, 30 with a narrower width and, further thereto, due to the gradual variation of the petals in size, the decorative property of the artificial flower is even more improved.

Figure 3:
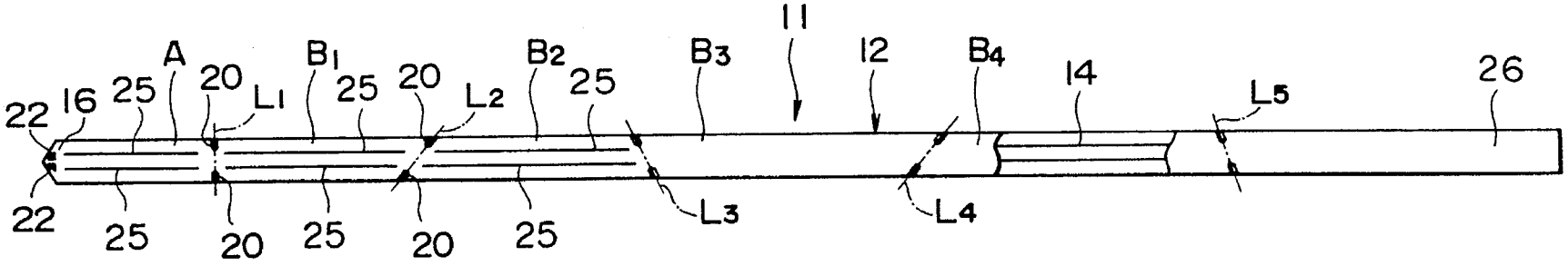
FIG. 3 is a plan view of the artificial-flower-forming ribbon of another embodiment relative to the present invention.

Another embodiment of a ribbon 11 is shown in FIG. 3. In this embodiment, two slits 25 are provided in the portions A, $B_1$ and $B_2$ of each strip 12. In place of this embodiment, three or more slits (not shown) may be provided. Also in this embodiment, the distance between the joint 22 at one ends 16 of both the strips and the line $L_1$ adjacent thereto, and the distance between respective pairs of lines, that is, between $L_1$ and $L_2$, between $L_2$ and $L_3$, between $L_3$ and $L_4$, and between $L_4$ and $L_5$ may be set to gradually increase from the one ends 16 of both the strips toward the other ends 26.

Figure 4:
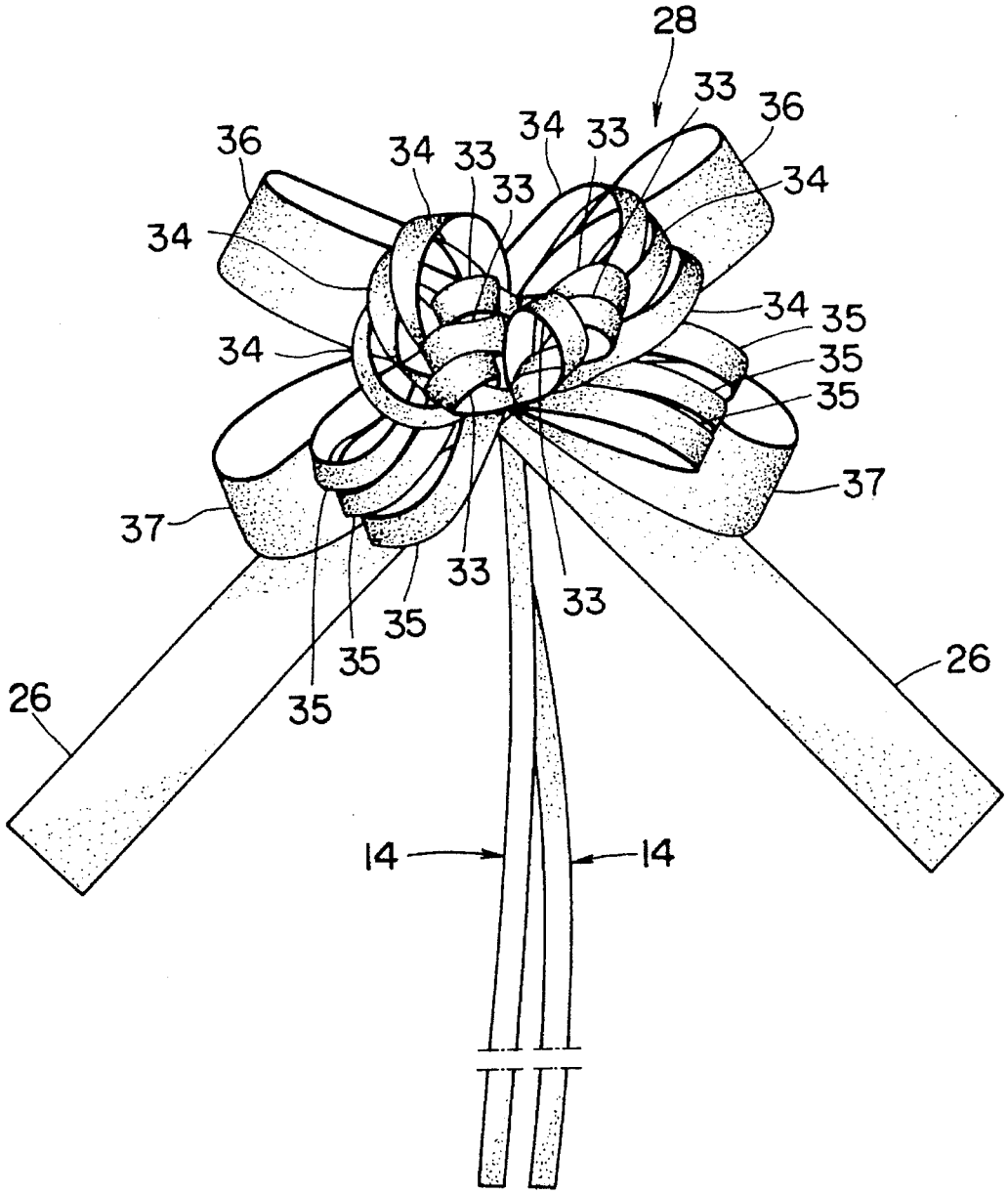
FIG. 4 is a perspective view of the artificial flower formed from the ribbon shown in FIG. 3.

According to the ribbon 11 of this embodiment, when the portions A and B of each strip 12 provided with two slits 25 are respectively transformed into loop-like shapes, three independent petals 33–35 with a narrow width are formed from respective portions A and $B_1$, $B_2$ as shown in FIG. 4. The numerals 36, 37 show loop-like transformed portions of the portions $B_3$, $B_4$ without the slit 25.

In place of each illustrated embodiment in which the slits 25 equally divide widthwise the confronting portions A and $B_1$, $B_2$ of both the strips 12, the slits 25 may be provided so as to unequally divide. Also, the length of the slit 25 can be arbitrarily determined. Further, when a plurality of slits 25 are provided, they may be set to have different lengths in place of the illustrated embodiment in which a plurality of slits 25 have the same length.

Figure 5:
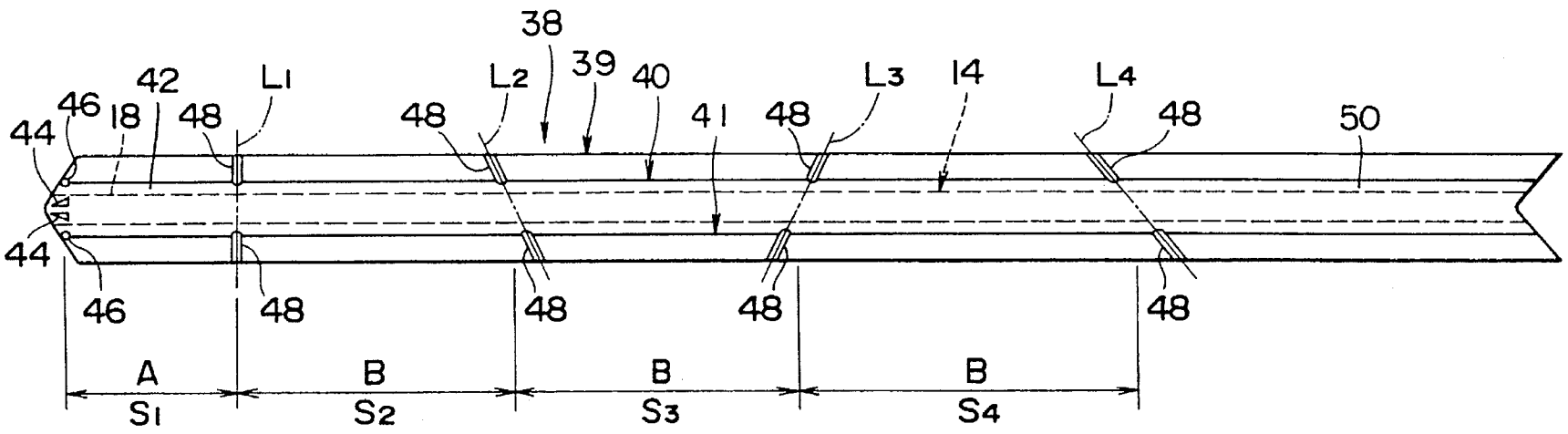
FIG. 5 is a plan view of another form of artificial-flower-forming ribbon according to the present invention.
Figure 6:
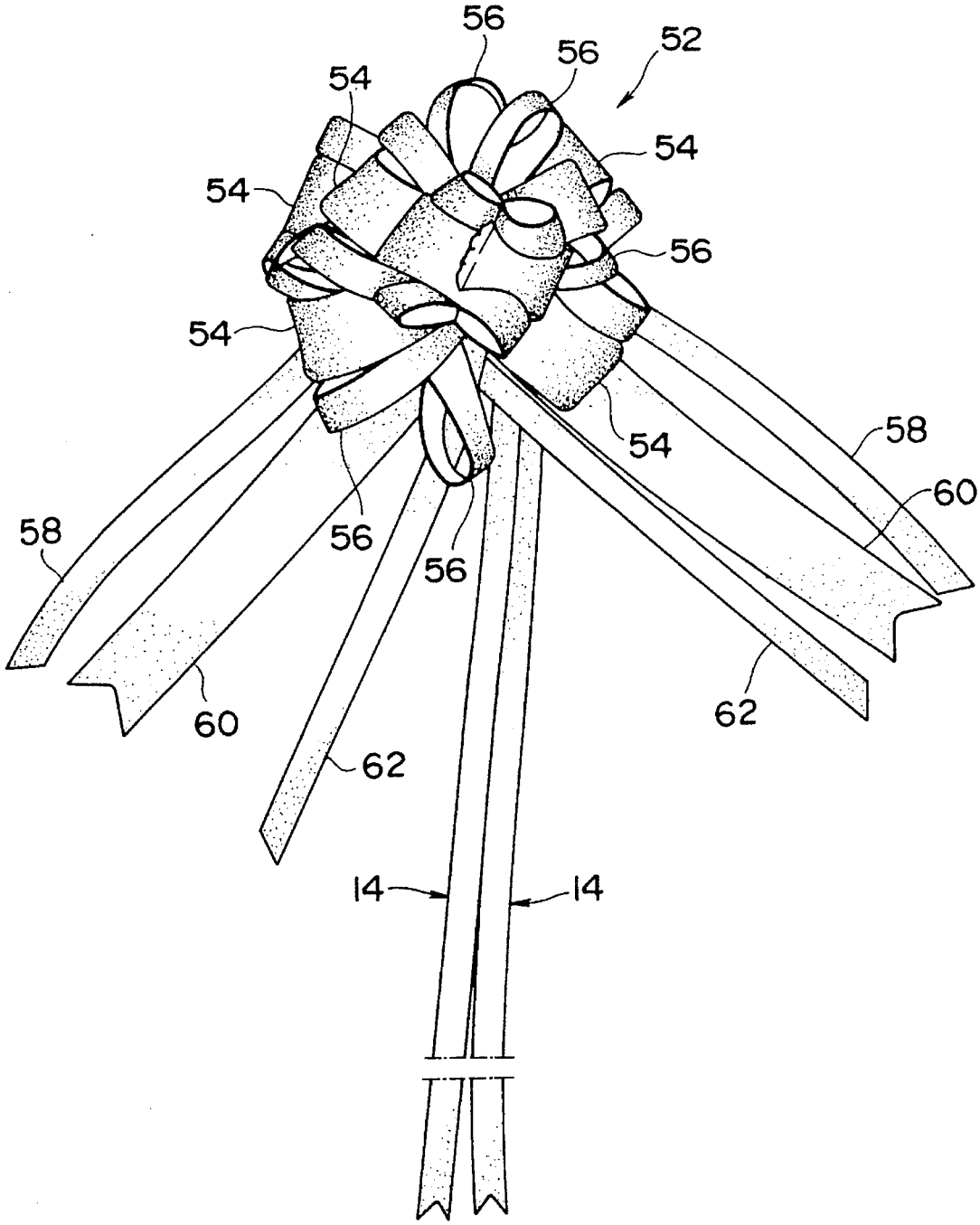
FIG. 6 is a perspective view of the artificial flower formed from the ribbon shown in FIG. 5.

Next, referring to FIGS. 5 and 6, an artificial-flower-forming ribbon 38 shown therein has three juxtaposed pairs of confronting strips 39, 40, 41, and at least one string 14 (two in the illustrated embodiment) is disposed between one pair of strips 40 in the middle row to extend along the strips.

In the illustrated embodiment, the pair of strips 40 in the middle row has the broadest width, and other pairs of strips 39, 41 positioned at both sides of the strips 40 have the same width. The width of each pair of the strips 39, 40, 41 can be arbitrarily set. Also, there may be two, four or more pairs of strips forming rows, in place of three in the illustrated embodiment.

The pair of strips 40 in the middle row and the string 14 are joined together at a portion or point 44 at their one ends 42, 18. Also, the pair of strips 40 in the middle row and two pairs of strips 39, 41 are joined together at portions or points 46 of their one ends. Accordingly, it can be said that the one end of the string 14 is substantially joined to three pairs of strips 39, 40, 41.

Each pair of confronting strips 39, 40, 41 as well as the strips 39, 40, 41 in a row and adjacent to each other are joined together at a plurality (two in the illustrated embodiment) of points 48 on each of a plurality of lines $L_1$–$L_4$ spaced apart from each other in the longitudinal direction so that the strips can be moved relative to the string 14 in the longitudinal direction of the string.

In this embodiment, too, a distance $S_1$ between the joint 44 at one ends 42 of the strips and the line $L_1$ adjacent thereto and each of distances $S_2$, $S_3$, and $S_4$ between the lines $L_1$–$L_4$, respectively, can be determined arbitrarily, but they are preferably determined, as in the illustrated embodiment, to gradually increase from the one ends 42 of the strips toward the other ends 50.

According to this ribbon 38, an artificial flower 52 (FIG. 6) can be formed by moving the three pairs of strips 39–41 relative to the string 14 leftward as viewed in FIG. 5. With the relative movement of the three pairs of strips, the three rows of the strips joined together at the joints 46 and 48 are transformed into loops respectively at the portion A between the joints 44, 46 at their one ends and the line $L_1$ adjacent to the joints 44, 46 as well as the portion B between each pair of lines $L_1$–$L_4$ adjacent to each other in the longitudinal direction. As a result, two sets of three loop-like petals are obtained in each of the portions A, B. The reference numerals 54, 56 in FIG. 6 show respectively the petals formed from the broad strip 40 in the middle row, and-the petals formed from the narrow strips 39, 41. Also, in this embodiment, the strips 39–41 are presented in a state where the other ends 58, 60, 62 thereof are separated from each other.

A plurality of petals of respective sets show fineness, gorgeousness and the like to contribute and improve the decorative property of the artificial flower 52.

What is claimed is:

1. An artificial-flower-forming ribbon comprising: a plurality of juxtaposed pairs of confronting strips, and at least one string disposed between one of said pairs of strips, wherein one pair of said strips and said string are joined together at one of their ends, and wherein each pair of said strips and a plurality of said pairs of strips are joined to each other at a plurality of points on each of a plurality of lines spaced apart from each other in their longitudinal direction so that said plurality of said pairs of strips can be moved relative to said string in the longitudinal direction of said string.

2. An artificial-flower-forming ribbon according to claim 1, wherein the distances between said lines gradually increase from one of said ends of said strips toward the other of said ends.

* * * * *